United States Patent [19]

Davis, Jr. et al.

[11] Patent Number: 4,462,869

[45] Date of Patent: Jul. 31, 1984

[54] PIPELINE CHARGING ENTRY INTO COKE OVENS

[75] Inventors: Rufus F. Davis, Jr., Kenwood, Ky.; Donald G. Marting, Murray Hill, N.J.; Harvey S. Auvil, Ashland, Ky.

[73] Assignee: Krupp Wilputte Corporation, Murray Hill, N.J.

[21] Appl. No.: 790,212

[22] Filed: Apr. 25, 1977

[51] Int. Cl.[3] ..... C10B 31/04; C10B 45/00

[52] U.S. Cl. ..... 201/40; 202/262

[58] Field of Search ..... 201/40; 202/262; 302/59

[56] References Cited

U.S. PATENT DOCUMENTS

| | | | |
|---|---|---|---|
| 3,047,473 | 7/1962 | Schmidt | 201/4 |
| 3,374,151 | 3/1968 | Schmidt | 201/40 X |
| 3,523,065 | 8/1970 | Schmidt | 201/40 |
| 3,753,867 | 8/1973 | Wiemer | 202/262 |
| 3,761,360 | 9/1973 | Auvil et al. | 201/40 |
| 4,165,260 | 8/1979 | Bugajski | 201/40 |

*Primary Examiner*—Bradley Garris

*Attorney, Agent, or Firm*—Buell, Blenko, Ziesenheim & Beck

[57] ABSTRACT

A method and apparatus for conveying preheated coal particles to a coking chamber through an enclosed pipeline by means of a pressurized inert carrier gas, wherein the coal particles are charged into the top of the coking chamber through a portion of the pipeline wherein at least the end of which is disposed vertically or not more than 30° from vertical. The advantages of the top charging technique include one or more of the following: reduced carryover of fine coal during charging, increased density of the charge of coal to be coked, reduced weight of carrier gas per unit weight of coal, improved uniformity of coal bed level throughout the coking chamber, and reduced carbon deposits on surfaces of the chamber above the coal charge and in the gas off-takes.

2 Claims, 4 Drawing Figures

PIPELINE CHARGING ENTRY INTO COKE OVENS

This invention relates to methods and apparatus for charging preheated coal particles by means of a stream of inert conveying or carrier gas into a chamber or oven where the coal is subsequently converted to coke. In particular, the invention relates to an improved charging technique in which the coal enters the top of the chamber through a pipeline which directs the stream of coal and carrier gas in a vertical or substantially vertical direction.

BACKGROUND OF THE INVENTION

In the manufacture of coke from coal a batch of coal is charged to a coking oven where it is subjected to a high temperature at which volatiles are driven off from the coal. A typical system includes a battery of coke ovens which contains a large number of coking chambers disposed side-by-side along the length of the oven. For the most part charging of the chambers is performed mechanically by dumping coal from a larry car into each chamber through a plurality of vertically facing charging openings located in the top of each chamber.

In more recent years a new method for charging of the chambers has been developed which effects charging through enclosed pipelines in which dried, preheated coal particles are transported by an inert pressurized conveying or carrying gas into each coke oven chamber. The carrier gas, such as superheated steam or coke oven gas, may be introduced into the pipeline along its length through a number of strategically placed jets which propel the coal in the desired direction and which prevent the coal from settling to the bottom of the pipeline. Usually the coal particles to be delivered to one or more ovens are fed into a generally horizontal main pipeline which extends the length of the oven at an elevation somewhat above the top of the oven. For each chamber there is provided a branch pipeline which connects at its upstream end with the main pipeline by means of a diverter valve. The downstream or discharge end of each branch pipeline is a straight length which passes through the top or the end wall of the respective coking chamber at one end thereof at an angle of about 15° to 30° from the horizontal. The branch pipeline is curved just prior to the straight discharge end portion to induce an internal flow pattern which causes some separation between the coal and the carrier gas. A portion of the carrier gas is usually tapped from the pipeline at this point in order to increase the coal to gas ratio of the mixture entering the chamber. A gas take-off pipe extends through the top of the chamber at the end thereof opposite the location of the coal inlet pipeline.

A typical coke oven of contemporary design is of a size to hold a charge of from about 15 to 35 tons or more of coal and there may be 20 to 90 such chambers in a given coke oven battery. Such chambers, which have a volumetric capacity of from about 600–1600 cubic feet, are approximately 35 to 50 feet long, from 11 to 22 feet high and approximately 1½ feet wide. The feed rate into the oven typically may range from about 2 to 6 tons per minute. The coal particles after being preheated to 250° F.–700° F. are introduced into the main pipeline and are conveyed therealong at a rate in the range of about 10–200 ft/sec by steam at 4–50 psig. The weight ratio of coal to steam typically is in the range 20 to 350 to 1 at the upstream portion of the main pipeline and in the range 40 to 500 to 1 at the discharge end of the branch pipeline.

The coal is discharged into the chamber essentially in a fluidized condition and the fluidized condition is maintained for a short period of time. Disentrainment of the coal particles from the carrier gas occurs slowly, causing the fluidized mixture to flow the length of the chamber as carrier gas flows through the gas take-off pipe. Disentrainment takes place slowly enough and uniformly enough to disperse the coal particles from the entry end along the length of the chamber. On the other hand disentrainment takes place rapidly enough to avoid charging the chamber to excessive or dangerous levels and to avoid excessive carry over of coal fines in the carrier gas leaving the chamber through the gas take-off pipe.

All of the above is disclosed in more detail in U.S. Pat. Nos. 3,374,151, 3,432,398, 3,457,141, 3,523,065, 3,537,755 and 3,761,360 the specifications of which are incorporated herein by reference. U.S. Pat. No. 3,761,360 recognizes some of the problems which arise during the charging of coal by pneumatic conveying, such as the carry-over of coal fines by the carrier gas and the disability of the technique to fill the chamber to an absolutely predetermined depth completely along the length of the chamber. Reduction of the carry-over of coal fines is desirable from the economic standpoint of reducing the amount of fines which must be recycled. A uniformly full chamber is desirable from the standpoint of obtaining maximum capacity and a uniform coke product. It is generally desirable also to form a bed of coal particles which is as dense as possible and to employ as small an amount of carrier gas as possible. Higher densities are not preferable where wall pressure generated during the coking cycle is near the maximum acceptable limit for coke ovens.

SUMMARY OF THE INVENTION

According to the present invention a pneumatic pipeline for charging preheated coal particles into a coking chamber enters the chamber through a portion of the pipeline at least the end of which is disposed vertically or not more than 30° from vertical, so that the coal particles enter the oven at an angle which is no more than 30° from the vertical, rather than the coal particles exiting the end of the pipeline and entering the chamber at an angle of 60° or more relative to vertical as in prior charging systems. It has been found by comparative tests that by making this change in charging geometry it is possible to charge a coking chamber more economically in terms of reduced carry-over of coal fines by the carrier gas and in terms of greater uniformity of coal level in the chamber. In addition the technique can produce a greater charging rate in terms of pounds of coal per pound of conveying steam and in some instances it can produce a bed of greater density.

DESCRIPTION OF EXEMPLARY EMBODIMENT

The invention will be further understood from the following more detailed description taken with the drawings in which.

For convenience, in the following description common numerals are used for identifying the same or similar elements.

Figure 1:
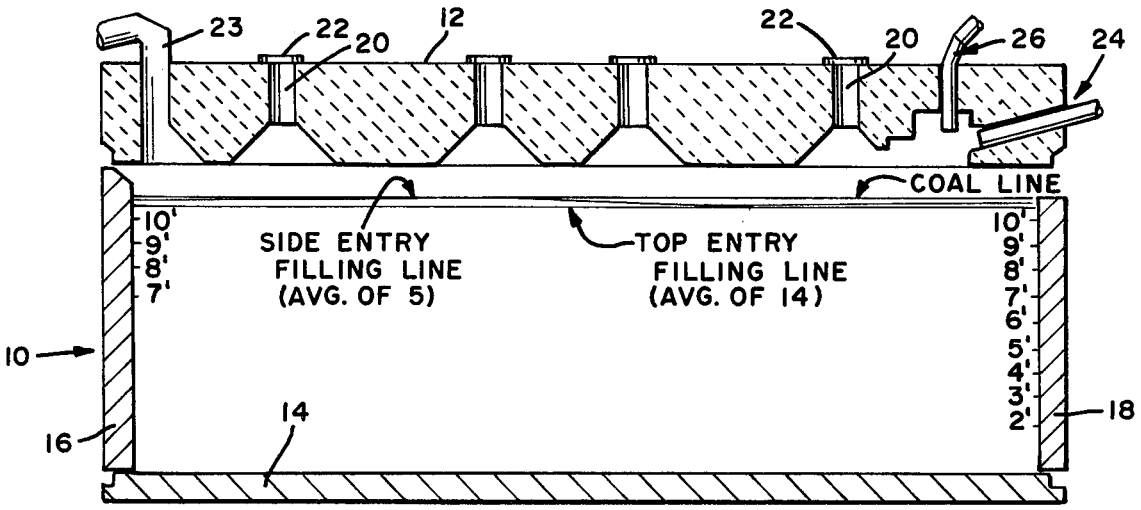
FIG. 1 is a schematic vertical sectional view through a test coking chamber fitted with a conventional side entry charge pipe and with a vertical top entry charge pipe.

Referring to FIG. 1 there is shown a coking chamber 10 having a top 12 or roof, a bottom wall 14 and end walls 16 and 18. The top 12 has four charging holes 20 formerly employed during charging by a larry car but not employed for charging by a pneumatic charging technique. The charging holes are closed by covers 22.

Figure 2:
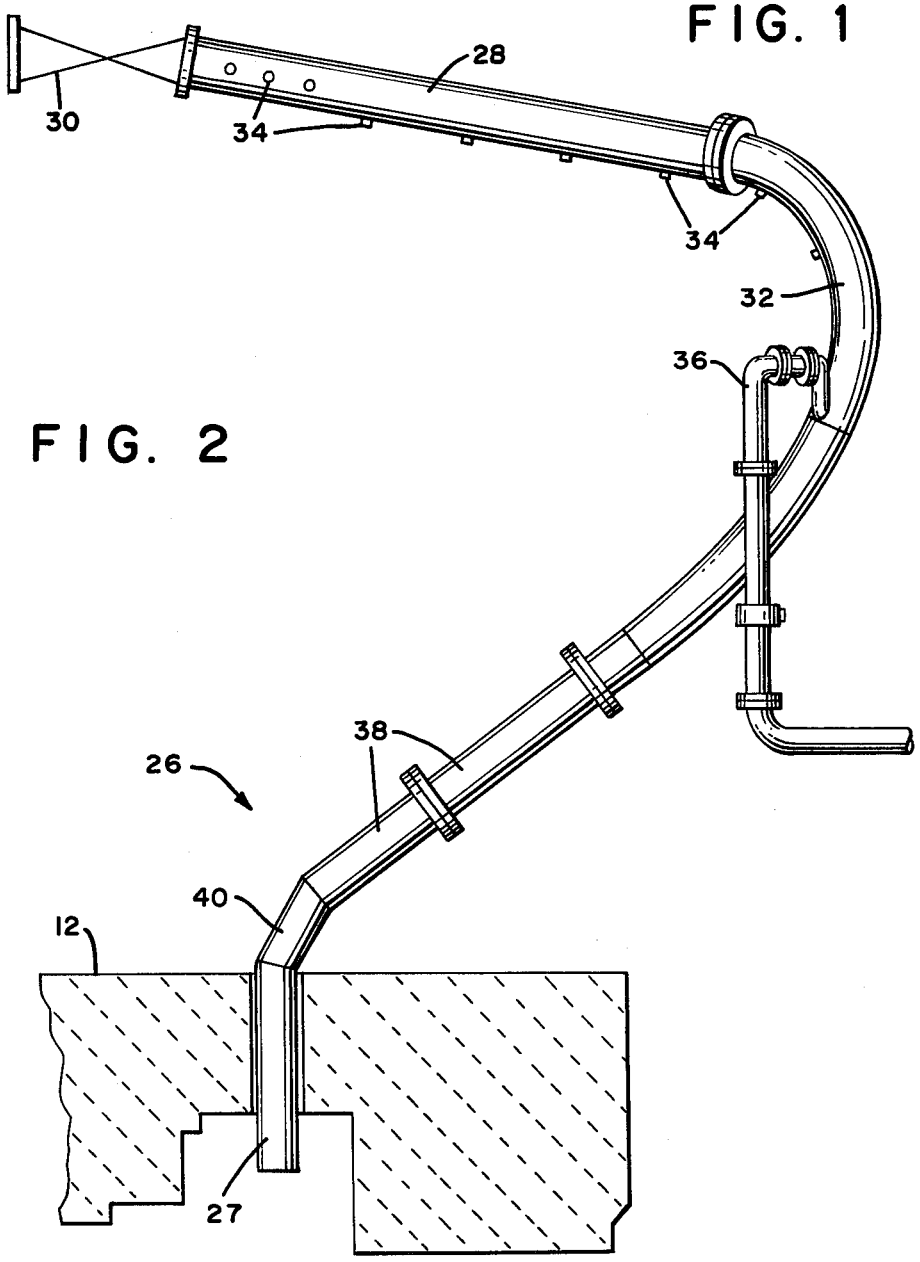
FIG. 2 is a schematic elevational view of a test vertical charge pipe similar to that shown in FIG. 1, but on a larger scale.
Figure 3:
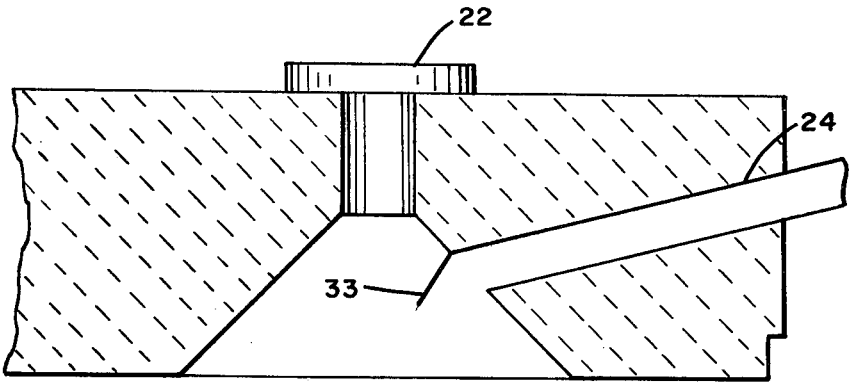
FIGS 3 and 4 are fragmentary vertical sections showing end views of an oven with modified side entry charge pipes leading into the oven chamber incorporating at the discharge end deflector means which permit entry of the coal particles into the oven chamber at an angle of no more than 30° from the vertical.
Figure 4:
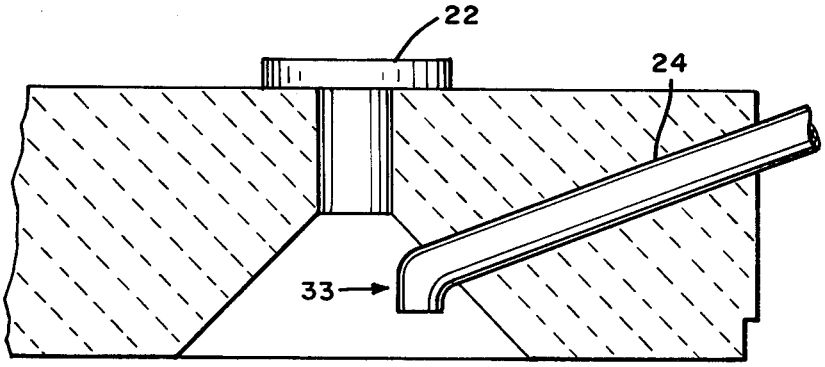

The coking chamber 10 is shown as being fitted with a side entry charging pipe 24 and with a top entry charging pipe 26 each of which projects through the top 12 of the chamber 10. The side entry pipe 24 may be of the kind described in the United States patents previously referred to, and the top entry pipe 26 is constructed and arranged in accordance with the present invention. Alternatively, as shown in FIGS. 3 and 4 side entry charge pipes, such as at existing installations, may be modified by utilizing deflector means 33 placed at the discharge end of side entry pipeline 24. Both kinds of charging pipes are shown, because in developing the present invention an existing chamber previously fitted with a side entry charging pipe (without modification) was also fitted with a top entry pipe in order to compare the charging characteristics of the two pipes. A gas take-off pipe 23 is provided in the top 12 at the opposite end of the chamber from the charging pipes 24 and 26. The top entry charging pipe 26 of the present invention is illustrated in FIG. 2 although in the interest of simplicity of illustration some of the known features, such as the carrier gas inlet jets, and various controls have been omitted. It will be understood that the conveying of hot coal particles through the pipe 26 by a carrier gas, such as steam, can be established and controlled using any or all of the features of the aforesaid patents.

The most important feature of the top entry charge pipe 26 or a modified side entry charge pipe 24 is that it discharges a mixture of coal particles and carrier gas into the upper part of the chamber 10 axially from the end of the charge pipe 26 or 24 in a downward direction which is not greater than 30° from a vertical direction. This discharge feature of the present invention is accomplished by arranging the discharge end portion 27 of the top entry pipe 26 or the discharge end 33 of side entry pipe 24 such that its axis at the discharge point is disposed at an angle of not more than 30° from a vertical direction. In the top entry embodiment the discharge portion 27 preferably is a straight length which passes through the top 12 of the chamber. The discharge end portion may be curved provided that a tangent at its open end is within 30° of the vertical. Generally speaking the portions of the pipe 26 above the discharge end portion 27 may be constructed according to the aforesaid patents. However there should not be a sharp angle between the discharge portion 27 and the remainder of the pipe 26 to minimize retention of coal particles in that section of the branch pipeline when the diverter valve is closed The remainder of the pipe will usually include a general arcuate section for separating a portion of the carrier gas from the coal particles. This arcuate section may be arranged in a position such that the pipe portion 27 is generally tangent to its lower end. Alternatively the arcuate section may be arranged in a position which requires the provision of straight and/or oppositely curved sections in order to connect the arcuate section with the pipe discharge portion 27.

An important advantage of the top entry embodiment of the present invention is that it permits installation of the entry pipe at any convenient point into the oven chamber above the normal coal line. In the illustrated embodiment of FIG. 1 the vertical entry pipe 26 was located at the end of the oven opposite the gas off take pipe 23 to allow for the larry car to traverse the top of the battery.

In the illustrated embodiment of FIG. 2 the upstream end of the charging pipe 26 includes a downwardly inclined straight length 28 of pipe which receives a stream of preheated coal particles and carrier gas from a diverter valve 30. The downstream end of the straight length 28 is connected to a downwardly curved arcuate section 32 which may lie in a vertical plane or, as shown, may be skewed out of a vertical plane. The straight length 28 and the upper portion of the arcuate section 32 in this test pipeline are provided with spaced-apart jets (not shown) for introducing carrier gas. Suitable locations for the jets are shown at 34. The purpose of the arcuate section 32 is to effect some centrifugal separation of coal particles from the carrier gas, the excess gas being bled off through a bleed pipe 36. While avoiding a bleed off will result in reducing steam and coal losses and lower installation, operation and maintenance costs, data developed indicate that there is lower coal fines carry-over in gas off-take pipes when bleed off is provided. Additionally, by employing the invention in co-pending application Ser. No. 643,964, filed Dec. 24, 1975, and now U.S. Pat. No. 4,060,458, the bleed off stream may be directed into the main pipeline downstream from the branch pipeline from where the bleed off is obtained and thus recover the steam and coal particles in the bleed off. The parts 30, 32, 34 and 36 may be as described in the aforesaid patents and do not require further description for purposes of the present invention.

The lower end of the arcuate section 32 merges into a straight downwardly inclined length 38 which is generally tangent to the lower end of the arcuate section 32. As shown, the length 38 is disposed at about 40° above horizontal. In this test pipeline a short length 40 of inclined pipe, shown at about 63° above horizontal, connects the lower end of the length 38 with the upper end of the final top entry discharge pipe portion 27.

The operation of the system in the conveying of preheated coal from the valve 30 and through pipe sections 28, 32, 38, and 40 may be as described in the aforesaid patents and only a general description need be given here. A stream of hot coal particles and carrier gas enters the upper end of the pipe 26 through the valve 30 and flows through the pipe 26 under the action of further carrier gas injected at locations 34 into the test pipe 26 in a downstream direction. In the arcuate section 32 centrifugal force causes some separation of coal particles from the carrier gas, and the gas which is separated is bled off through the pipe 36. The coal particles and the remaining carrier gas flow through the pipe portions 38 and 40 and are discharged into the coking chamber through the pipe portion 27. The change in inclination between portions 38 and 40 serves as a reentrainment section to reentrain coal particles which may have settled out of the stream. Reentrainment is discussed in U.S. Pat. No. 3,761,360, referred to previously.

The functions of the discharge pipe portion 27 include the same basic function as a prior art side entry charging pipe in that the mixture of coal particles and carrier gas leaving the pipe portion becomes fluidized, with the result that the particles spread out from one end of the chamber to the other. Upon settling from the carrier gas the particles gradually fill the chamber, preferably to a predetermined "coal line" which is illustrated in FIG. 1, and the carrier gas passes out of the chamber through the take-off pipe 23. "Coal line" is shown as an ideal charging and leveling situation In practice the level of the upper surface of the coal bed formed by the settled particles will not be completely uniform along the length of the chamber and the deviation from the coal line is usually expressed as a positive or negative number indicating the number of inches above or below, respectively, the coal line. In practice, also, the carrier gas leaving the chamber contains some dispersed fine coal particles.

As shown in FIGS. 3 and 4 an existing side entry pipeline 24 may be modified by providing at the end of this entry pipeline deflector means 33 which may include either an oval plate (FIG. 3) or elbow (FIG. 4). The inside portion of the deflector means which comes in contact with the preheated coal particles preferably has been either treated to increase its surface hardness, provided with a laminated surface of increased surface hardness or is constructed of a material to resist wear from the coal coming in contact with the surfaces of this portion of the entry pipeline. In the embodiment of FIG. 3 the oval plate can be welded to the end of the side entry pipe at all contact surfaces and as shown is about 15° to the vertical and is directed to the oven chamber. When an elbow element is shown in FIG. 4 the elbow radius "R" is 6 inches for a 6 inch diameter entry pipeline and 8 inches for an 8 inch diameter entry pipeline. The curvature of the elbow is determined by establishing a horizontal coal discharge plane and providing minimum clearance to allow for insertion into the entry ports in the side of the ovens. In this embodiment the coal discharge plane is horizontal. Suitable laminate include ½" thick Vulcalloy which has a Rockwell-L hardness of about 60. Equivalent materials or treatments to provide a surface hardness equal to a Rockwell-L hardness of 60 may be used. While not shown, if the entry pipe enters the top of the oven at an angle greater than 30° to the vertical appropriate deflector means may be provided at the discharge end of this type of entry pipe to cause the preheated coal particles to flow into the oven axially from the discharge end of the pipeline in a downward direction which is not greater than 30° from a vertical direction.

It has been found, however, that the use of a top entry charging pipe disposed within 30° of the vertical effects several advantages over the use of a side entry pipe disposed 30° or less above horizontal. The most important advantage is a reduction in the carry-over of coal fines in the carrier gas leaving the chamber during the charging operation. Other advantages include an increase in the density of the bed formed in the chamber, reduced weight of carrier gas per unit weight of coal, improved uniformity of bed level along the length of the chamber and reduced carbon deposits on surfaces of the chamber above the bed and in the gas take-off pipe.

EXAMPLE 1

A coking chamber of the type illustrated in FIGS. 1 and 2 was charged by both a side entry charging pipe disposed at about 20° above horizontal and a vertical top entry pipe all other variables being as constant as possible. Five side entry runs and fourteen top entry runs were made. The total amount of coal fines in the carrier gas leaving the chamber during each run was measured.

Coal carry-over into take-off pipe was determined by sampling the effluent from the gas collector main during the charging period and for 10 minutes following, and determining the filterable solids minus any tarry material in the effluent. From this, the total coal during the sampling period was computed and then compared with a blank sample of the effluent sampled, preferably, just prior to the test period. Since the equilibrium condition of the take-off pipe liquor can be easily affected by any of the operating functions on a coke oven battery (pushing, charging, main steaming, and others), the solids concentration in the liquor can be quite variable even going to negative figures where blank determinations indicate higher solids than during actual charge. However, indications are that averages of several trials do give a reasonably good order of magnitude of the coal carried over into the main. Even with the variable figures, the data obtained indicate that the top entry carry-over is less than side carry-over.

| Run No. | Pounds of Coal Fines Carried Over |
|---|---|
| 1 (side entry) | 110 |
| 2 (side entry) | 22 |
| 3 (side entry) | −77 |
| 4 (side entry) | 141 |
| 5 (side entry) | 52 |
| 6 (top entry) | 357 |
| 7 (top entry) | 10 |
| 8 (top entry) | 9 |
| 9 (top entry) | 29 |
| 10 (top entry) | 4 |
| 11 (top entry) | 64 |
| 12 (top entry) | 88 |
| 13 (top entry) | −17 |
| 14 (top entry) | −171 |
| 15 (top entry) | 111 |
| 16 (top entry) | 60 |
| 17 (top entry) | 216 |
| 18 (top entry) | 25 |

Run No. 6 showing an exceptionally high carry-over appears to have resulted from a malfunction of unidentified origin. When this run is desregarded the average side entry carry-over is 50 pounds and the average top entry carry-over is 36 pounds.

EXAMPLE 2

Another series of runs were made to determine coal fines carry-over wherein a side entry pipeline was modified by providing it with a deflector at its discharge end wherein the preheated coal particles were introduced into the coke oven in a downward direction no greater than 30° from a vertical direction. In some of the runs no bleed off from the branch pipeline was provided. In a series of 7 trial runs using a side entry pipeline which had bleed off during the charging operation the average carry-over amounted to 74 pounds per oven charge. In a run using a plate deflector on the discharge end of the side entry pipeline which had bleed off during the charging operation the carry-over of coal particles measured —66 pounds (blank determination indicated higher solids than during the run). When the bleed off was not used the average carry-over for 2 trial runs was 66 pounds. Also, the leveling characteristics of the charge improved by about 50% when the deflector plate was used in comparison to the runs when conventional side entry charging was used. Further, when the deflector plate was used very little carbon deposition within the oven and gas off-takes was observed.

EXAMPLE 3

Charging a coking chamber with discharge pipe portions arranged at 90°, 60°, 45°, and 20° above horizontal were compared in terms of the density of the coal beds formed in the chamber. All other variables remained as constant as practicable.

It has been found from an analysis of the test data that charge density increases 0.011 lbs. per cubic foot for each degree increase in the angle of the straight entry pipe above horizontal. For instance, changing from 20° to 90° yields an increase in density of $70\times0.011=0.77$ lbs/ft.$^3$ or an increase of about 1.6%, basis a typical density of 48 lbs/ft.$^3$

EXAMPLE 4

Another series of runs were conducted in which a top entry pipeline was provided in the test oven which was 30° from the vertical. In comparison a series of runs were conducted using an existing side entry pipeline with no deflector provided at its discharge end.

The average oven filling for three side entry trials proved to be virtually the same as for seven top entry trials at 94.7% by volume of coal line full capacity. The average charge weight for the side entry was 14.6 tons and the top entry average was slightly higher at 14.7 tons of preheated coal. The distribution of coal in the oven was indicated by the coal levels measured.

Charge density figures derived from oven filling data ranged from 49.1 to 55.8 pounds per cubic foot for the side entry charges and from 50.0 to 52.4 for top entry trials.

The extent of oven leveling was indicated by the deviation from the average level. The side entry trial average showed a deviation of plus 3.2 inches at #3 charging hole and a minus 4.2 inches at #1 charging hole for a total variance of 7.4 inches. The top entry trial average showed a deviation of plus 2.1 inches at #2 charging hole and a minus 1.5 inches at #4 charging hole for a variance of 3.6 inches. These results show that top entry trials gave somewhat better leveling than side entry trials.

The average coal conveying rate for side entry charges was 2.45 tons per minute compared with 2.52 tons per minute for top entry charges, a difference of about 2.8%.

The jet steam flow to the pipeline was about the same for both top and side entry trials, 44.2 PPM for top trials and 44.0 for side entry trials. However, due to line configuration and total number of steam jets involved, the actual amount of conveying steam to the oven up to the bleed off point was 34.4 PPM for side entry and 30.6 PPM for the top entry. Based on this steam flow rate and the total coal charged the corresponding average coal to steam ratios were 143 for the side entry and 166 for the top entry.

The average lid pressure at #1 charging hole during the charging operation was 1.4 inches of water for top entry and 1.2 inches of water for side entry. Bleed off pressures were 2.6 PSIG and 2.1 PSIG, respectively, for top entry and for side entry.

Coal carry-over into the collector main during charging averaged 98 pounds per charge for the four side entry trials and 56 pounds per charge for six of the eight top entry trials.

In a limited number of tests, the amount of coal in the bleed off stream was found to be 497 pounds in a side entry test and 459 pounds in a top entry test.

What is claimed is:

1. In a method of charging a coking chamber defined within an enclosure by conveying through the enclosure and into the chamber a stream of preheated coal particles carried by an inert carrier gas within an enclosed pipeline and discharging a mixture of coal particles and carrier gas from the end of the pipeline into the upper part of the chamber in a manner such that the coal particles spread throughout the chamber and settle out of the carrier gas, the improvement comprising passing the stream as it approaches the enclosure through a curved path which becomes straight and then becomes curved in an opposite mode with respect to said curved path and discharging said mixture into said chamber axially from the end of the pipeline in a vertically downwardly direction which is not greater than 30° from a vertical direction.

2. An apparatus for charging coal particles into a coking chamber defined within an enclosure, said apparatus including an enclosed pipeline passing through the enclosure and having a discharge end portion in communication with the upper part of the chamber and means for conveying a stream of preheated coal particles in a carrier gas through the pipeline so as to be discharged from said discharge end portion of the pipeline in an axial direction into the chamber in a generally downward direction, an improved configuration of said pipeline wherein the axis of said discharge end portion at the discharge point is disposed vertically at an angle of not more than 30° from a vertical direction wherein said discharge end portion of said pipeline enters said coking chamber by a side entry and has provided at its discharge end deflector means and wherein said pipeline as it approaches the enclosure includes a first curved portion which merges into a straight portion, wherein said straight portion merges into a second curved portion which is curved in an opposite mode with respect to said first curved portion.

* * * * *

UNITED STATES PATENT AND TRADEMARK OFFICE

CERTIFICATE OF CORRECTION

PATENT NO. : 4,462,869

DATED : July 31, 1984

INVENTOR(S) : Rufus F. Davis, Jr., Donald G. Marting, Harvey S. Auvil

It is certified that error appears in the above-identified patent and that said Letters Patent is hereby corrected as shown below:

Column 5, line 15, insert a period after situation.

Column 5, line 46, change "1/2" to --1/8--.

Signed and Sealed this

*Nineteenth* Day of *February 1985*

[SEAL]

*Attest:*

DONALD J. QUIGG

*Attesting Officer* *Acting Commissioner of Patents and Trademarks*